United States Patent [19]

Crotty

[11] 4,359,348

[45] Nov. 16, 1982

[54] STABILIZED TRIVALENT CHROMIUM PASSIVATE COMPOSITION AND PROCESS

[75] Inventor: David E. Crotty, Highland Park, Mich.

[73] Assignee: Occidental Chemical Corporation, Warren, Mich.

[21] Appl. No.: 274,601

[22] Filed: Jun. 17, 1981

[51] Int. Cl.[3] ..... C23F 7/26

[52] U.S. Cl. ..... 148/6.16; 148/6.2

[58] Field of Search ..... 148/6.2, 6.16

[56] References Cited

U.S. PATENT DOCUMENTS 4,171,231 10/1979 Bishop ..... 148/6.2

*Primary Examiner*—Sam Silverberg

*Attorney, Agent, or Firm*—Richard P. Mueller

[57] ABSTRACT

An aqueous acidic solution and process for treating metal surfaces, particularly zinc and zinc alloy surfaces, for depositing a passivate film to impart improved corrosion resistance thereto. The solution contains effective amounts of chromium ions substantially all of which are present in the trivalent state, hydrogen ions to provide a pH of about 1.2 to about 2.5, an oxidizing agent, a stabilizing agent comprising a mixture of 1—hydroxy ethylidene—1,1 diphosphonic acid and citric acid as well as the bath soluble and compatible salts thereof present in an amount effective to stabilize the oxidizing agent and pH of the aqueous acidic solution, and at least one additional metal ion selected from the group consisting of iron, cobalt, nickel, molybdenum, manganese, aluminum, lanthanum, cerium, lanthanide mixture as well as mixtures thereof. The treating solution may optionally further contain a bath soluble and compatible silicate compound, halide ions, a carboxylic acid or salt thereof and a wetting agent.

50 Claims, No Drawings

STABILIZED TRIVALENT CHROMIUM PASSIVATE COMPOSITION AND PROCESS

BACKGROUND OF THE INVENTION

A variety of chromium containing aqueous solutions have heretofore been used or proposed for treating zinc, zinc alloy, cadmium and cadmium alloy surfaces for improving the corrosion resistance properties thereof and to further enhance the appearance of such surfaces by imparting a yellow or a blue-bright coating thereto, the latter simulating a chromium finish. Such treating solutions originally contained chromium in the hexavalent state and in more recent years the chromium constituent was present as a mixture of the hexavalent and trivalent forms. The reduced toxicity of trivalent chromium and the increased simplicity and efficiency in treating waste effluents containing trivalent chromium has occasioned an increased commercial use of treating solutions in which the chromium constituent is substantially entirely in the trivalent state. Such prior art trivalent chromium passivating solutions have been found to be somewhat less effective than the hexavalent chromium passivate solutions in imparting good corrosion resistance to the zinc, zinc alloy, cadmium and cadmium alloy surfaces treated and there has, accordingly, been a continuing development of further improvements in trivalent chromium passivate treatment solutions and processes.

The foregoing problem has been further aggravated by a conversion from conventional cyanide zinc and cadmium plating processes to acid and alkaline non-cyanide electroplating baths which produce metal deposits which are not as receptive to chromium passivate treatments.

Typical of prior art compositions and processes for treating zinc and zinc alloy surfaces are those disclosed in U.S. Pat. Nos. 2,393,663; 2,559,878; 3,090,710; 3,553,034; 3,755,018; 3,795,549; 3,880,772; 3,932,198; 4,126,490; 4,171,231; British Pat. Nos. 586,517 and 1,461,244; and German Pat. No. 2,526,832.

While improvements have been made in trivalent chromium passivate compositions and processes to produce commercially acceptable passivate films, a continuing problem associated with such operating baths has been the relatively rapid loss of the peroxide-type oxidizing agent, particularly hydrogen peroxide, which is present as a necessary bath constituent to achieve acceptable passivate films. Such prior art operating baths also undergo a relatively rapid rise in pH necessitating careful control and addition of acids to maintain the pH level within the optimum operating range. The progressive loss of the peroxide-type oxidizing agent, particularly hydrogen peroxide, is due in part to the presence of actiavting metal ions present in the solution as well as contaminating metal ions such as zinc or cadmium, for example, introduced by dissolution of the metal from the substrates being treated which tend to catalyze a decomposition of the peroxide oxidizing agent. The progressive loss of the peroxide-type oxidizing agents occurs not only during processing but also during standing of the bath overnight and over weekends during plant shutdown. Typically, a fresh operating bath containing 3% by volume of a 35% solution of hydrogen peroxide on standing overnight will lose about 0.1% by volume per hour of the hydrogen peroxide oxidizing agent while a used solution containing from about 2 to about 10 grams per liter of contaminating zinc ions will experience a loss of hydrogen peroxide at a rate as great as about 0.4% by volume per hour. It will be apparent from the foregoing that careful monitoring of the operating bath composition and frequent replenishment of the peroxide oxidizing agent is required to maintain optimum bath efficiency which is not only costly but also time consuming.

The present invention provides a treating solution and process which is effective to impart improved corrosion resistance to zinc, zinc alloy, cadmium and cadmium alloy, as well as aluminum and magnesium surfaces and to impart a desirable surface finish which can range from a clear bright to a light blue-bright to a yellow iridescent appearance, which produces a passivate film of improved corrosion resistance, hardness, durability, clarity and initial hardness, which provides a treating solution that is stabilized against rapid loss of the peroxide oxidizing agent and against a rapid rise in pH, which process is simple to control and operate and which is of efficient and economical operation.

SUMMARY OF THE INVENTION

The benefits and advantages of the present invention are achieved in accordance with the composition aspects thereof by providing an aqueous acidic treating solution containing as its essential constituents, chromium ions substantially all of which are present in the trivalent state at a concentration of from about 0.05 grams per liter (g/l) up to saturation, hydrogen ions to provide solution pH of about 1.2 to about 2.5 which can be conveniently introduced by mineral acids such as sulfuric acid, nitric acid, hydrochloric acid or the like, an oxidizing agent of which hydrogen peroxide itself is preferred present in an amount of about 1 to about 20 g/l, a stabilizing additive comprising a mixture of 1-hydroxy ethylidene—1,1 diphosphonic acid and citric acid and the bath compatible and soluble salts thereof present in an amount effective to reduce loss of the peroxide oxidizing agent and to stabilize the pH of the operating bath, and at least one additional metal ion selected from the group consisting of iron, cobalt, nickel, molybdenum, manganese, aluminum, lanthanum, cerium and lanthanide mixtures, as well as mixtures thereof present in an amount effective to activate the bath and formation of a chromium passivate film of the desired appearance on the substrate treated. The solution may optionally contain halide ions for imparting additional hardness to the coating, a wetting agent, a bath soluble and compatible silicate compound present in an amount effective to impart increased corrosion resistance and hardness to the passivate film, and a bath soluble compatible organic carboxylic acid present in an amount effective to further impart initial hardness and clarity to the passivate film.

In accordance with the process of the present invention, zinc, cadmium or zinc alloy or cadmium alloy surfaces are contacted with the aqueous acidic treating solution preferably at a temperature ranging from about 40° to about 150° F., preferably from about 70° to about 90° F. for a period of time typically ranging from about 10 seconds to about one minute to form the desired passivate coating thereon. The passivated substrate can be dried after treatment or optionally, if desired, can be subjected to a final rinse, preferably after an intervening water rinse, in a dilute aqueous silicate solution at a temperature of about 50°to about 150° F. for a period of time usually ranging from about one second up to about one minute or more to further enhance the properties of the passivate film whereafter the surfaces are air dried.

Additional benefits and advantages will become apparent on a reading of the Description of the Preferred Embodiments taken in conjunction with the examples provided.

DESCRIPTION OF THE PREFERRED EMBODIMENTS

The present invention is particularly applicable but not limited to the treatment of alkaline and acidic non-cyanide zinc electrodeposits to impart improved corrosion resistance and a decorative appearance to the threaded substrate. Particularly satisfactory results are obtained on decorative zinc electrodeposits of the bright and semi-bright types although beneficial effects are also achieved on zinc and zinc alloy substrates such as galvanized substrates, zinc die casings and substrates comprised of cadmium or alloys of cadium predominantly comprised of cadmium. While the invention as herein described is particularly directed to the treatment of zinc and zinc alloy surfaces, it has been observed that beneficial results are also obtained in the treatment of aluminum, aluminum alloy, magnesium and magnesium alloy surfaces to form a passivate film or coating thereon. Accordingly, the present invention in its broad sense is directed to the treatment of metal surfaces which are receptive to the formation of a passivate film thereon when contacted with the solution of the present invention in accordance with the process parameters disclosed.

In the case of decorative zinc electroplatings, a further enhancement of the appearance of such substrates in addition to the corrosion resistance imparted is achieved by the passivate film which ranges from a clear bright to a light blue bright appearance simulating that of a chromium deposit or alternatively, a clear light-yellow appearance simulating that obtained by use of prior art hexavalent chromium solutions.

In accordance with the present invention, the treating solution contains as its essential constituents, chromium ions which are present substantially all of the trivalent state, hydrogen ions to provide a pH of from about 1.2 to about 2.5, an oxidizing agent in an amount effective to activate the hydrated trivalent chromium to form a chromate film on the metal surface, the diphosphonic/-citric acid stabilizing additive, and at least one additional metal ion selected from the group consisting of iron, cobalt, nickel, molybdenum, manganese, aluminum, lanthanum, cerium and lanthanide mixtures of rare teeth metals as well as mixtures thereof present in an amount effective to impart integral hardness of the gelatinous chromate film. The treating solution may optionally further contain halide ions including fluoride, chloride and bromide ions for further increasing the hardness of the passivate film, one or more compatible wetting agents for achieving efficient contact with the substrate being treated, a bath soluble and compatible silicate compound present in an amount of about 0.01 to about 5 g/l calculated as $SiO_2$, and a bath soluble and compatible organic carboxylic acid present in an amount effective to further impart initial hardness and clarity to the passivate film of the structural formula:

$$(OH)_aR\ (COOH)_b$$

Wherein:

a is an integer from 0 to 6;

b is an integer from 1 to 3; and

R is an alkyl, alkenyl, or aryl containing from $C_1$ to $C_6$ carbon atoms; as well as the bath soluble and compatible salts thereof.

The trivalent chromium ions can be introduced in the form of any bath soluble and compatible salt such as chromium sulfate $Cr_2(SO_4)_3$, chromium alum $[KCr(SO_4)_2]$, chromium chloride $[CRCL_3]$, chromium bromide $[CrBr_3]$, chromium fluoride $[CrF_3]$, chromium nitrate $Cr(NO_3)_3$, or the like. The trivalent chromium ions can also be introduced by a reduction of a solution containing hexavalent chromium ions employing an appropriate reducing agent of any of the types well known in the art to effect a substantially complete stoichiometric reduction of all of the hexavalent chromium to the trivalent state.

The concentration of the trivalent chromium ions in the treating solution may range from as low as about 0.05 g/l up to saturation with quantities of about 0.2 to 2 g/l being preferred. Typically, the operating bath contains from about 0.5 to about 1 g/l trivalent chromium ions.

The treating bath contains hydrogen ions in an amount to provide a pH of about 1.2 to about 2.5 with a pH range of about 1.5 to about 1.8 being preferred for producing clear to light-blue passivate films and a pH of about 1.5 to about 2.0 for yellow passivate films. Acidification of the operating bath to within the desired pH range can be achieved by a variety of mineral acids and organic acids such as sulfuric acid, nitric acid, hydrochloric acid, formic acid, acetic acid, propionic acid and the like of which sulfuric acid and nitric acid are preferred. The presence of sulfate ions in the bath has been found beneficial in achieving the desired passivation of the substrate and can be introduced by the sulfuric acid addition or sulfate salts of the other bath constituents. Sulfate ion concentrations can range in amounts up to about 15 g/l with amounts of about 0.5 to about 5 g/l being preferred.

The treating bath further contains an oxidizing agent or agents which are bath compatible of which peroxides including hydrogen peroxide and metal peroxides such as the alkali metal peroxides are preferred. Hydrogen peroxide itself of a commercial grade containing about 25% to about 60% by volume peroxide constitutes the preferred material. Other peroxides that can be employed include zinc peroxide. Additionally, ammonium and alkali metal persulfates have also been found effective as oxidizing agents.

The concentration of the oxidizing agent or mixture of oxidizing agents is controlled to achieve the desired surface appearance of the treated substrate. Typically, the concentration of the oxidizing agent can range from about 1 to about 20 g/l with an amount of about 3 to about 7 g/l being preferred calculated on a weight equivalent effectiveness basis to hydrogen peroxide.

A further essential constituent of the treating bath comprises a stabilizing agent comprising a mixture of 1-hydroxy ethylidene—1,1 diphosphonic acid and citric acid as well as the bath soluble and compatible salts thereof. The combination of the diphosphonic and citric acid constituents appears to provide a synergistic action in not only reducing the decomposition and rate of loss of the peroxide-type oxidizing agent but also in stabilizing the pH of the operating bath preventing a rapid rise as had heretofore been experienced in prior art-type trivalent chromium passivation treating solutions. Typically, the two stabilizing constituents are added in the acid form or as the alkali metal and ammonium salts thereof. A commerically available material suitable for use is sold under the brand name Dequest 2010 by Monsanto Chemical Company and comprises 1-hydroxy ethylidene—1,1 diphosphonate.

The diphosphonic acid or diphosphonate constituent can be present in the operating bath in an amount of about 0.05 up to about 3 g/l with amounts of about 0.1 to about 0.5 g/l being preferred. The citric acid or citrate constituent can be present in the operating bath from about 0.1 to about 10 g/l with amounts of about 0.5 to about 1.5 g/l being preferred.

An optional but preferred constituent of the treating bath comprises a silicate compound present in an amount effective to provide an improved corrosion protection and hardness to the passivate film formed on the treated substrate. The silicate compound comprises a bath soluble and compatible inorganic or organic silicate compound as well as mixtures thereof which are present in an amount of about 0.01 up to about 5 g/l calculated as $SiO_2$, with concentrations of about 0.1 to about 0.5 g/l being preferred. When inorganic silicates are employed, concentrations above about 2 g/l in the operating bath are undesirable because of the tendency of the silicate to form fine flocculent precipitates with the metal ions present in the bath under the acidic conditions present which contributes toward bath instability. Organic silicates, on the other hand, provide for improved bath stability and are preferred for the formation of make-up and replenishment concentrates because of the improved stability and prolonged shelf life.

Inorganic silicates suitable for use in the practice of the present invention include alkali metal and ammonium silicates of which sodium silicate [$Na_2O.xSiO_2$(x=2–4] and potassium silicate [$K_2O.ySiO_2$(y=3–5)] are preferred for economic reasons. Organic silicates which can also be satisfactorily employed include quaternary ammonium silicates which include tetramethylammonium silicate, phenyltrimethylammonium silicate, disilicate and trisilicate, and benzyltrimethylammonium silicate and disilicate. Such silicates meeting the purposes of this invention are expressed by the following general formula:

$$ROR':xSiO_2:yH_2O$$

Where R is a quaternary ammonium radical substituted with four organic groups selected from the groups alkyl, alkylene, alkanol, aryl, arkylaryl or mixtures thereof, where R′ is either R or hydrogen, where x equals 1 to 3 and where y equals 0 to 15.

Such water soluble organic silicates including their synthesis and characterization is more fully described in literature such as the article by Merrill and Spencer, "Some Quaternary Ammonium Silicates", published in the Journal of Physical and Colloid Chemistry, 55, 187 (1951), the substance of which is incorporated herein by reference. Similar silicates including typical synthesis thereof is disclosed in U.S. Pat. No. 3,993,548 to which reference is also made for further details.

In addition, the bath further contains at least one additional metal ion selected from the group consisting of iron, cobalt, nickel, molybdenum, manganese, aluminum, lanthanum, cerium, lanthanide mixtures as well as mixtures thereof. The foregoing metal ions or mixtures of metal ions are conveniently introduced into the bath by way of bath soluble and compatible metal salts including the sulfates, nitrates, halide salts, or the like. For economic reasons, the lanthanum ions are introduced not as a pure lanthanum compound, but as a mixture of the rare earth salts of the metals of the lanthanide series, (hereinafter designated as "lanthanide mixture") which contains lanthanum compounds as the redominant constituent. A commercially available lanthanide mixture which is suitable for use in the practice of the present invention is Lanthanum—Rare Earth Chloride, Product Code 5240, available from Molycorp, Inc. of White Plains, New York. This product has the general formula La—$RECl_3$. $6H_2O$ and is available as a solution containing about 55 to 60% by weight solids. The solution is prepared from a rare earth oxide (REO) concentrate containing a minimum of 46% by weight total REO comprising about 60% lanthanum oxide ($La_2O_3$), 21.5% neodymium oxide ($Nd_2O_3$), 10% cerium oxide ($CeO_2$), 7.5% praseodymium oxide ($Pr_6O_{11}$) and 1% of residual REO. The presence of such other rare earth metals in the solution does not appear to have any adverse effect at the low concentrations in which they are present and may further contribute to the activation of the treating solution in forming the passivate film.

The foregoing metal ions or combinations thereof with the exception of cerium ions are employed for producing a clear to a light-blue passivate film. When a light-yellow iridescent passivate film is desired, cerium ions are employed, preferably in combination with one or more of the other metal ions to produce a passivate film simulating in appearance the light yellow passivate films heretofore obtained employing hexavalent chromium passivating solutions which have been recognized and embodied in ASTM specifications in view of their characteristic color and associated excellent corrosion resistance. The cerium ions can be introduced in the form of any bath soluble and compatible cerium salt including cerium sulfate [$Ce(SO_4)_2$. $4H_2O$]; halide salts such as cerous chloride [$CaCl_3$. $6H_2O$]; nitrate salts such as cerium nitrate [$Ce(NO_3)$.$5H_2O$], [$Ce(NO_3)_3(OH)$.3-$H_2O$] and the like.

Usually, at least some of the serium ions are introduced into the bath in the tetravalent state to impart the characteristic yellow color of the tetravalent cerium ion into the passivate film. Certain oxidzing agents such as hydrogen peroxide, act as a reducing agent under the acid conditions prevalent in the bulk of the operating bath and reduce some of the tetravalent cerium ions to the trivalent state. However, oxidizing agents such as hydrogen peroxide revert from a reducing agent to an oxidizing agent at the interface of the substrate being treated due to the higher pH prevalent at the interface and oxidize at least some of the trivalent cerium ions to the tetravalent state which are deposited in the film and impart the characteristic yellow color thereto. When using such oxidizing agents as hydrogen peroxide, accordingly, all of the cerium ions can, if desired, be initially introduced into the operating bath in the trivalent state of which a portion are oxidized to the tetravalent state at the interface of the substrate. The passivate film usually contains a mixture of trivalent and tetravalent cerium compounds and the intensity of the yellow color of the film is dictated by the concentration of tetravalent cerium compounds present. The cerium sulfate compound, due to solubility difficulties, is preferably added to the bath in the form of an acid solution such as a sulfuric acid solution containing the cerium sulfate dissolved therein.

The concentration of cerium ions in the operating bath can range from about 0.5 up to about 10 g/l with concentrations of from about 1.0 to about 4.0 g/l being preferred. The concentration of cerium ions is in part influenced by the magnitude of the yellow coating desired and higher concentrations of the cerium ions produce corresponding increases in the yellow color of the passivate film.

Because of cost considerations, the cerium ions are preferably introduced as a commercially available mixture of rare earth salts of metals in the lanthanide series which contains cerium compounds as the principal component. One such commercially available material is a cerous chloride solution containing about 46% solids of which $CeCl_3.6H_2O$ predominates. The cerous chloride solution is derived from a rare earth oxide (REO) concentrate sold by Molycorp, Inc. of White Plains, New York under product code 5310 containing a minimum of 99 percent total REO of which $CeO_2$ is 96%, $La_2O_3$ is 2.7%, $Nd_2O_3$ is 1% and $Pr_6O_{11}$ is 0.3%. A ceric sulfate solution is commercially available from the same source containing about 42% solids of which $Ce(SO_4)_2.H_2O$ predominates and which is also prepared from product code 5310 containing other rare earth metal compounds in similar minor amounts.

The concentration of the additional metal ions other than cerium ions for appropriate activation of the treating bath to produce a clear to blue-bright appearance is controlled to provide a concentration ranging from about 0.02 up to about 1 g/l with concentrations of from about 0.1 to about 0.2 g/l being preferred. While such metal ions can be used in concentrations above 1 g/l, such as, up to 10 g/l, the use of such higher concentrations even in the absence of cerium ions tends to produce dull films of a yellow tint rather than the desired clear or light-blue films. For this reason, such higher concentrations are undesirable from an appearance standpoint.

Optionally, the operating bath may contain an organic carboxylic acid or salt thereof of the structural formula as hereinbefore set forth present in an amount effective to impart increased clarity and initial hardness to the gelatinous chromate film deposited. The improvement in clarity of the film is particularly pronounced in connection with the light-yellow iridescent films produced from cerium ion containing solutions. The presence of the silicate compound in the operating bath has been found to also contribute to improved clarity of the passivate film, and accordingly, the use of the organic carboxylic acid addition agent is usually unnecessary when a silicate compound is employed in the bath.

The particular concentration or range of concentrations of the clarity/hardness agent, if used, will vary in proportion to molecular weight of the particular acid and/or metal salt employed with higher concentrations required or an equivalent effectiveness as the molecular weight of the additive agent increases. The particular concentration to achieve optimum clarification and hardness is also dictated to some extent by the concentration of the silicate and other metal ions present in the bath with higher concentrations being used as the metal ion concentrations increase. Generally, the organic carboxylic acid additive agent or metal salts thereof can be employed in amounts ranging up to about 4.0 g/l with concentrations of about 0.1 to about 1.0 g/l being typical.

The additive can be introduced as the organic acid itself or as any bath soluble and compatible metal salt including the alkali metal salts, ammonium salts and salts of the several additional metal ions in the bath. For economic reasons, the organic acid is usually introduced as an acid or as the sodium or potassium salt thereof.

Within the scope of the structural formula as hereinabove set forth, organic carboxylic acids which have been found particularly suitable include malonic, maleic, succinic, gluconic, tartaric and citric, of which succinic or succinate salts have been found particularly effective.

As a further optional but preferred constituent, the bath contains halide ions including chloride, bromide and fluoride ions which have been found to enhance the hardness of the passivate film on the treated substrate. The halide ions or mixture thereof can conveniently be introduced employing any of the alkali metal and ammonium salts thereof as well as salts of the metal ions hereinabove set forth. The concentration of the total halide constituent in the bath normally may range up to about 2 grams per liter with concentrations of about 0.1 to about 0.5 g/l being typical.

In addition to the foregoing, the use of a small effective amount of a variety of bath compatible wetting agents also provides beneficial results in the nature of the passivate film deposited. When employed the wetting agent can be present in concentrations up to about 1 gram per liter (g/l) with concentrations of about 50 to about 100 mg/l being preferred. Wetting agents suitable for use in the treating bath include aliphatic fluorocarbon sulfonates available from 3M under the Fluorad brandname, such as, for example, Fluorad FC 98, which is a nonfoaming wetting agent and its use at about 100 mg/l in the working bath improves the color and hardness of the passivate film. A second class of suitable wetting agents is the sulfo derivatives of succinates. An example of this class is Aerosol MA-80 which is a dihexyl ester of sodium sulfosuccinic acid and is commercially available from American Cyanamid Company. A third class of suitable wetting agents is the sulfonates of naphthalene which are linear alkyl naphthalene sulfonates, such as Petro Ba, for example, available from Petrochemical Company.

The operating bath can be conveniently prepared by employing a concentrate containing the active constituents with the exception of the oxidizing agent and cerium ions, if used, which is adapted to be diluted with water to form a bath containing the constituents within the desired concentration range. Similarly, replenishment of the bath on a continuous or intermittent basis can be achieved employing a concentrate of the active constituents with the exception of the oxidizing agent and cerium ions, if used, which is added separately to the operating bath. Typically, a bath make-up concentrate can contain from about 10 to about 80 g/l chromium ions, from about 5 to about 50 g/l of at least one additional metal ion of the group consisting of iron, cobalt, nickel, molybdenum, manganese, aluminum, lanthanum, lanthanide mixture or mixtures thereof, halide ions up to about 50 g/l, from about 5 to about 30 g/l of a silicate compound, if used, calculated as $SiO_2$; and a suitable surfactant in an amount up to about 5 g/l if employed. Such a make-up concentrate is adapted to be diluted with about 98 volume percent water to produce an operating bath containing the active constituents within the ranges specified. The oxidizing agent such as hydrogen peroxide, for example, is separately introduced into the bath preferably in a form commercially available containing from about 35 to 40 percent by volume hydrogen peroxide. The cerium ions, when employed, are preferably introduced in the form of an aqueous acid solution of cerous chloride or ceric sulfate having cerium ion concentration of from about 200 to about 320 g/l and about 60 to about 100 g/l, respectively. Such cerium concentrates may be conveniently comprised of the commercially available materials hereinbefore described available from Molycorp, Inc.

The foregoing trivalent chromium concentrate containing the metal ions and acid components in combination with an inorganic silicate compound has a tendency to form precipitates during prolonged storage due to the high concentrations and acidic conditions present. Accordingly, such foregoing concentrates are normally diluted with water shortly after preparation to provide an operating bath containing the active constituents in the desired concentrations. Concentrates of substantially improved stability and prolonged shelf storage life can be provided by the use of organic silicates of the types heretofore set forth in combination with the trivalent chromium ions and, optionally, halide ions and a wetting agent. Such stable concentrations conventionally contain from about 10 to about 80 g/l trivalent chromium ions, about 5 up to about 50 g/l of an organic quaternary ammonium silicate calculated as $SiO_2$, halide ions up to about 50 g/l and a surfactant in an amount up to about 5 g/l. Such stable concentrate is adapted to be used in conjunction with a second concentrate containing the acid components, the additional metal ions in an amount of about 5 to about 50 g/l, up to 80 g/l of the organic carboxylic acid and/or salt additive agent if used. Such second concentrate can also optionally contain a portion or all of the halides and wetting agents if not employed in the first trivalent chromium concentrate.

In the preparation of such a trivalent chromium/silicate concentrate, the organic silicate is first diluted with water to the desired concentration range whereafter the trivalent chromium constituent is added along with the optional halide and wetting agent, if employed. A particularly suitable commercially available organic silicate compound comprises Quram 220 available from Emery Industries which comprises a quaternary amine silicate.

The diphosphonic acid and citric acid and/or diphosphonate and citrate stabilizing additive can be incorporated in any of the foregoing concentrates including the peroxide concentrate in an amount to attain the desired concentration in the operating bath. Alternatively, the stabilizing additive can be prepared as a separate aqueous concentrate containing from about 30 to about 170 g/l of the diphosphonic/diphosphonate compound in admixture with about 160 to about 500 g/l of the citric acid/citrate compound and added separately to the operating bath to provide the desired working concentration in accordance with the limits hereinbefore specified, and typically, 4–5 g/l of the stabilizer concentrate. In accordance with a preferred practice, the stabilizing additive is incorporated directly in the chromium containing concentrate, the cerium ion concentrate in the case of a yellow passivate process, or in the second concentrate employed in conjunction with the organic silicate concentrate in amounts of about 3 to about 17 g/l diphosphonic acid/diphosphonate compound and about 16 to about 50 g/l citric acid/citrate compound.

In accordance with the process aspects of the present invention, a treating bath formulation as hereinabove described is applied to a substrate to be treated by spray, immersion, flooding or the like for a period of time sufficient to form the desired passivate film thereon. The treating solution is preferably controlled within a temperature range of about 40° to about 150° F., with about 70° to about 90° F. being preferred. Temperatures above about 90° F. have a tendency to cause increased loss of peroxide-type oxidizing agents whereas temperatures below about 70° F. reduce the activity of the bath requiring increased contact times to achieve a passivate film of the same thickness or color intensity as can be achieved at the higher temperatures at shorter time intervals. Typically, contact times of about 20 seconds to about 1 minute are satisfactory with contact times of about 30 seconds being usually preferred.

At the conclusion of the passivation treatment, the substrate is extracted from the treating solution and is dried such as by warm circulating air. Ordinarily, such passivated substrates, particularly work pieces processed while supported on a work rack are characterized as having a uniform passivate film over the surfaces thereof requiring no further processing. In the case of small work pieces which are treated in bulk such as in a rotating processing barrel, some damage such as scratches can occur in the passivate film during treatment and it is desirable in such instances to subject such work pieces to a post silicate rinse treatment to seal any such surface imperfections thereby substantially improving the corrosion protection of barrel-processed parts.

When such an optional post rinse treatment is employed, the substrate following the passivation treatment is preferably subjected to at least one or a plurality of water rinse steps usually at room temperature to remove residual passivate solution from the surfaces thereof whereafter the substrates are contacted with the post silicate rinse solution which may be at room temperature or at an elevated temperature up to about 150° F. for a period of at least about one second up to about one minute or longer.

The aqueous silicate rinse solution contains as its essential constituent, a bath soluble and compatible inorganic or organic silicate compound as well as mixtures thereof of the same type as previously described in connection with the passivate operating bath which is present in an amount of about 1 up to about 40 g/l, and preferably from about 5 to about 15 g/l calculated as $SiO_2$. Alkali metal silicates such as sodium and potassium silicate are usually preferred for economic reasons. The post silicate rinsed substrate after extraction from the rinse solution is dried such as by recirculating warm air.

In addition to the silicate compound, the silicate rinse solution can optionally contain a bath soluble and compatible wetting agent for enhancing contact with the passivated surface present in conventional amounts of about 0.05 up to about 5 g/l. The silicate rinse may also optionally include an emulsifiable organic substance such as an emulsifiable oil present in an amount of from about 1 up to about 50 g/l to provide an oily film on the non-electroplated interior surfaces of ferrous substrates to provide temporary protection against rusting during further processing steps of the parts. When such parts have surfaces which are completely passivated such as, for example, zinc die castings, the use of the optional emulsifiable oil is not necessary. Temporary rust protection can also be provided in lieu of an emulsifiable oil by use of an alkali metal or ammonium nitrite compound such as sodium nitrite in an amount of about 0.1 to about 1 g/l.

In order to further illustrate the present invention, the following examples are provided. It will be understood that the examples are provided for illustrative purposes and are not intended to be limiting of the scope of the invention as herein disclosed and as set forth in the subjoined claims.

EXAMPLE 1

An operating bath suitable for depositing a yellow passivate film on a receptive substrate is provided by forming a trivalent chromium concentrate designated as "Concentrate A" having a composition as follows:

| CONCENTRATE A | |
|---|---|
| Ingredient | Concentration, g/l |
| $Cr^{+3}$ | 30 |
| Quaternary Ammonium Silicate | 15 |
| NaCl | 15 |

The trivalent chromium ions are introduced as $Cr_2(SO_4)_3$ while the silicate compound is introduced as Quram 220 from Emery Industries.

A cerium ion concentrate designated as "Concentrate B" is provided having a composition as follows:

| CONCENTRATE B | |
|---|---|
| Ingredient | Concentration, g/l |
| $HNO_3$ (100%) | 60 |
| $H_2SO_4$ (100%) | 30 |
| $Fe_2(SO_4)_3$ | 25 |
| $Ce^{+3}$ | 120 |

The cerium ions are introduced by way of a cerium chloride solution containing about 300 g/l $Ce^{+3}$ ions.

In addition, an oxidizing agent concentrate is provided containing about 35% hydrogen peroxide.

A series of one 1 liter operating baths is prepared comprising 3% by volume Concentrate A, 3% by volume Concentrate B and 3% by volume of the oxidizing agent concentrate. In order to simulate an aged operating bath used for passivation of zinc workpieces, 1 g/l of zinc dust is dissolved in each test solution.

One such test solution without further additions is designated as test solution 1A and serves as the control sample. To a second test solution designated as 1B, 1 g/l of citric acid and 0.4 g/l of 1—hydroxy ethylidene—1,1 diphosphonate (Dequest 2010) is added as a stabilizing agent. To a second test solution designated as 1C, 1 g/l of citric acid and 0.08 g/l of 1—hydroxy ethylidene—1,1 diphosphonate (Dequest 2010) is added.

Each test solution is subjected to agitation at room temperature to simulate typical commercial practice. The pH at start and finish and the peroxide concentration measured in terms of volume percent of 35% hydrogen peroxide concentrate remaining in the bath was analyzed over a one-day period. The results are as follows:

HYDROGEN PEROXIDE CONCENTRATION AND pH

| | Test Sample | | | | | |
|---|---|---|---|---|---|---|
| | 1A | | 1B | | 1C | |
| Time | $H_2O_2$ | pH | $H_2O_2$ | pH | $H_2O_2$ | pH |
| Start | 2.56% | 1.6 | 2.95% | 1.6 | 3.05% | 1.4 |
| After 3.5 Hours | 2.39% | — | 2.92% | — | 2.84% | — |
| After 21 Hours | 0.83% | — | 1.72% | — | 2.37% | 1.7 |
| After 26 Hours | 0.50% | 2.5 | 1.42% | 1.8 | — | — |

From the results as set forth in the foregoing table, it is apparent that control sample 1A devoid of any stabilizing agent rapidly loses the peroxide oxidizing agent which should be present at a concentration of at least 2% by volume to maintain proper passivation treatment. An almost complete replenishment of the oxidizing agent in Sample 1A is therefore necessary after a period of about one day. In contrast, sample 1C exhibited only a small loss of peroxide after 21 hours while sample 1B containing a lesser quantity of Dequest 2010 in combination with 1 g/l of citric acid also exhibited a surprising superiority in peroxide stability over control sample 1A.

The stabilization of pH is also evident from the data set forth in the foregoing table. Control sample 1A rose to a pH level of 2.5 after 26 hours which would have necessitated the addition of acid to the operating bath to maintain the pH within the preferred operating range of 1.5 to 2.0. On the other hand, both samples 1A and 1B were substantially stable and remained within optimum pH range over the test duration.

EXAMPLE 2

An aqueous stabilizer concentrate is prepared containing 570 g/l citric acid and 110 g/l 1-hydroxy ethylidene—1,1—diphosphonate (Dequest 2010). Test operating solutions are prepared as described in Example 1 containing 3% by volume Concentrate A, 3% by volume Concentrate B, 3% by volume of the oxidizing concentrate and 1 g/l zinc dust for aging the baths. The control sample designated 2A devoid of any stabilizing agent had an initial peroxide concentration of 3% but after standing for a period of 18 hours under the conditions of Example 1 had a residual peroxide concentration of only 1.05% necessitating replenishment. A second test solution designated as 2B was stabilized by the addition of 2.5 milliliters/liter of the stabilizer concentrate and had an initial peroxide concentration of 3% and after a period of 18 hours had a residual peroxide concentration of 2.43 percent.

EXAMPLE 3

In order to evaluate the effectiveness of the peroxide and pH stabilizing agent of the present invention under actual commercial operation, the stabilizer concentrate as defined in Example 2 was employed for stabilizing a trivalent chromium passivate solution of a composition similar to the operating bath of Example 1 containing trivalent chromium ions, iron and cerium ions to provide a pH within the range of about 1.5 to about 2.0 at a temperature of about 70° F. and containing hydrogen peroxide as the oxidizing agent. Under normal operation, in the absence of the stabilizer agent, the commercial operating bath necessitated a replenishment of the peroxide oxidizing agent with the addition of 3% by volume of a 35% hydrogen peroxide concentrate each morning at the commencement of operation as well as the addition of another 1% by volume of the peroxide oxidizing concentrate after about 4 hours operation to maintain the bath at a minimum of 2% by volume oxidizing agent.

By the addition of 1 liter of the stabilizer concentrate per one hundred gallons of the operating bath, the replenishment of the peroxide oxidizing concentrate was reduced by only a 1% by volume replenishment each operating day and only a 2% by volume replenishment after standing over the weekend to restore the bath to a proper operating condition.

Additionally, the addition of the stabilizer concentrate to the operating bath further stabilized the operating pH over the six day test period wherein the pH remained substantially constant avoiding the necessity of acid addition to control pH. In contrast, the same commercial operating bath without any of the stabilizer concentrate necessitated frequent monitoring of pH and periodic addition of acid to maintain the pH within the desired range of 1.5 to 2.0.

Bright zinc electroplated parts processed employing the foregoing commercial operating bath after aging for at least 24 hours were subjected to a neutral salt spray corrosion test according to ASTM Procedure B-117. The excellent corrosion resistance of the yellow passivate film is evidenced by the absence of white corrosion on the parts after 96 hours salt spray testing.

EXAMPLE 4

The stabilization of a commercial operating bath of a composition and employing the procedure as described in Example 3 is achieved by preparing an aqueous stabilizer concentrate containing from about 30 to about 170 g/l of 1—hydroxy ethylidene—1,1 diphosphonate (Dequest 2010) in admixture with about 160 to about 500 g/l of citric acid. The stabilizing concentrate is added to the commercial operating bath to provide an operating concentration of the 1—hydroxy ethylidene—1,1 diphosphonate in an amount of about 0.05 to about 3 g/l and an operating concentration of the citric acid constituent of about 0.1 to about 10 g/l. Results obtained are similar to those as described in Example 3.

EXAMPLE 5

An operating bath suitable for depositing a yellow passivate film on a receptive substrate is provided by forming a concentrate designated as "Concentrate C" having a composition as follows:

CONCENTRATE C

| Ingredient | Concentration, g/l |
|---|---|
| $HNO_3$ (100%) | 60 |
| $H_2SO_4$ (100%) | 30 |
| $Fe_2(SO_4)_3$ | 25 |
| $FeCl_3$ | 5 |
| Diphosphonate* | 8.5 |
| Citric acid | 36 |
| $Ce^{+3}$ | 120 |

*Dequest 2010

An operating bath is prepared comprising 3% by volume of the chromium ion concentrate A of Example 1, 3% by volume of concentrate C and 3% by volume of the oxodizing agent concentrate containing about 35% hydrogen peroxide.

Steel test panels are subjected to an alkaline. non-cyanide electroplating step to deposit a zinc plating thereon after which they are thoroughly water rinsed and immersed with agitation in the passivate operating bath for a period of about 30 seconds at a temperature of about 70° F. and at a pH ranging from about 1.5 to about 2.0. The test panels are thereafter extracted from the operating bath and are dried with recirculating warm air.

The test panels after drying are visually inspected and are observed to have a uniform clear yellow passivate film thereover. The small addition of ferric chloride to the operating bath provides for an improvement in the color intensity of the yellow passivate film in comparison to that obtained employing the passivate operating bath of Example 1.

The test panels after aging are subjected to a neutral salt spray test in accordance with the procedure described in Example 3 and similar results are obtained.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic solution for treating receptive metal substrates to impart a chromate passivate film thereon comprising chromion ions substantially all of which are present in the trivalent state and present in an amount effective to produce a chromate film, hydrogen ions to provide an acidic ammonium persulfate or alkali metal pH, a solution compatible peroxide or persulfate oxidizing agent, a stabilizing agent comprising a mixture of 1—hydroxy ethylidene—1,1 diphosphonic acid and citric acid as well as the bath soluble and compatible salts thereof present in an amount effective to reduce loss of the oxidizing agent and inhibit a rise in the pH of the solution, and at least one additional metal ion selected from the group consisting of iron, cobalt, nickel, molybdenum, manganese, aluminum, lanthanum, cerium, lanthanide mixture and mixtures thereof present in an amount effective to impart increased corrosion resistance to the treated substrate.

2. The aqueous solution as defined in claim 1 in which the trivalent chromium ions are present in an amount of about 0.05 g/l up to saturation.

3. The aqueous solution as defined in claim 1 in which the trivalent chromium ions are present in an amount of about 0.2 to about 2 g/l.

4. The aqueous solution as defined in claim 1 in which the trivalent chromium ions are present in an amount of about 0.5 to about 1 g/l.

5. The aqueous solution as defined in claim 1 having a pH of about 1.2 to about 2.5.

6. The aqueous solution as defined in claim 1 having a pH of about 1.5 to about 2.0.

7. The aqueous solution as defined in claim 1 having a pH of about 1.6 to about 1.8.

8. The aqueous solution as defined in claim 1 in which said hydrogen ions are introduced by a mineral acid selected from the group consisting of sulfuric, nitric, hydrochloric and mixtures thereof.

9. The aqueous solution as defined in claim 1 in which said oxidizing agent is present in an amount of about 1 to 20 g/l calculated on a weight equivalent effectiveness basis to hydrogen peroxide.

10. The aqueous solution as defined in claim 1 in which said oxidizing agent is present in an amount of about 3 to about 7 g/l calculated on a weight equivalent effectiveness basis to hydrogen peroxide.

11. The aqueous solution as defined in claim 1 in which said oxidizing agent comprises a peroxide.

12. The aqueous solution as defined in claim 1 in which said oxidizing agent comprises hydrogen peroxide.

13. The aqueous solution as defined in claim 1 in which said 1—hydroxy ethylidene—1,1 diphosphonic acid and bath soluble and compatible salts thereof is present in an amount of about 0.05 to about 3 g/l.

14. The aqueous solution as defined in claim 1 in which said 1—hydroxy ethylidene—1,1 diphosphonic acid and bath soluble and compatible salts thereof is present in an amount of about 0.1 to about 0.5 g/l.

15. The aqueous solution as defined in claim 1 in which said citric acid and the bath soluble and compatible salts thereof is present in an amount of about 0.1 to about 10 g/l.

16. The aqueous solution as defined in claim 1 in which said citric acid and the bath soluble and compatible salts thereof is present in an amount of about 0.5 to about 1.5 g/l.

17. The aqueous solution as defined in claim 1 in which said one additional metal ion and mixtures thereof is present in an amount up to about 10 g/l.

18. The aqueous solution as defined in claim 1 in which said additional metal ion and mixtures thereof includes cerium ions present in an amount of about 0.5 to about 10 g/l.

19. The aqueous solution as defined in claim 1 in which said one additional metal ion and mixtures thereof includes cerium ions present in an amount of about 1 to about 4 g/l.

20. The aqueous solution as defined in claim 1 in which said one additional metal ion or mixtures thereof is present in an amount of about 0.2 to about 1 g/l.

21. The aqueous solution as defined in claim 1 in which said one additional metal ion or mixtures thereof is present in an amount of about 0.1 to about 0.2 g/l.

22. The aqueous solution as defined in claim 1 in which said one additional metal ion comprises iron.

23. The aqueous solution as defined in claim 1 in which said one additional metal ion comprises cobalt.

24. The aqueous solution as defined in claim 1 in which said one additional metal ion comprises nickel.

25. The aqueous solution as defined in claim 1 in which said one additional metal ion comprises molybdenum.

26. The aqueous solution as defined in claim 1 in which said one additional metal ion comprises manganese.

27. The aqueous solution as defined in claim 1 in which said one additional metal ion comprises lanthanum.

28. The aqueous solution as defined in claim 1 in which said one additional metal ion comprises a lanthanide mixture comprised predominantly of lanthanum compounds.

29. The aqueous solution as defined in claim 1 in which said one additional metal ion comprises aluminum.

30. The aqueous solution as defined in claim 1 further including a bath soluble and compatible silicate compound present in an amount of about 0.01 to about 5 g/l calculated as $SiO_2$.

31. The aqueous solution as defined in claim 30 in which said silicate compound is present in an amount of about 0.1 to about 0.5 g/l calculated as $SiO_2$.

32. The aqueous solution as defined in claim 30 in which said silicate compound comprises an inorganic bath soluble and compatible silicate compound present in an amount to about 2 g/l.

33. The aqueous solution as defined in claim 30 in which said silicate compound comprises an alkali metal and ammonium silicate compound present in an amount up to about 2 g/l.

34. The aqueous solution as defined in claim 30 in which said silicate compound comprises a quaternary ammonium silicate compound present in an amount of about 0.01 to about 5 g/l calculated as $SiO_2$.

35. The aqueous solution as defined in claim 30 in which said silicate compound comprises a quaternary ammonium silicate compound present in an amount of about 0.1 to about 0.5 g/l calculated as $SiO_2$.

36. The aqueous solution as defined in claim 30 in which said silicate compound is of a structural formula:

$$ROR':xSiO_2:yH_2O$$

wherein:

R is a quaternary ammonium radical substituted with four organic radicals selected from the group consisting of alkyl, alkylene, alkanol, aryl, arkylaryl, or mixtures thereof;

R' is R or H, x is an integer from 1 to 3, and y is an integer from 0 to 15.

37. The aqueous solution as defined in claim 1 further including a bath soluble and compatible organic carboxylic acid present in an amount effective to impart initial hardness and clarity to the passivate film of the structural formula:

$$(OH)_a R (COOH)_b$$

wherein:

a is an integer from 0 to 6;

b is an integer from 1 to 3; and

R is an alkyl, alkenyl, or aryl containing from $C_1$ to $C_6$ carbon atoms; as well as the bath soluble and compatible salts thereof.

38. The aqueous solution as defined in claim 37 in which said carboxylic acid and salts thereof is present in an amount of about 0.05 to about 4 g/l.

39. The aqueous solution as defined in claim 37 in which said carboxylic acid and salts thereof is present in an amount of about 0.1 to about 1 g/l.

40. The aqueous solution as defined in claim 37 in which said organic carboxylic acid is selected from the group consisting of malonic, maleic, succinic, gluconic, tartaric, citric and mixtures thereof as well as salts thereof.

41. The aqueous solution as defined in claim 1 further including halide ions.

42. The aqueous solution as defined in claim 41 in which said halide ions are present in an amount up to about 2 g/l.

43. The aqueous solution as defined in claim 41 in which said halide ions are present in an amount of about 0.1 to about 0.5 g/l.

44. The aqueous solution as defined in claim 1 further containing a surfactant.

45. The aqueous solution as defined in claim 44 in which said surfactant is present in an amount up to about 1 g/l.

46. The aqueous solution as defined in claim 44 in which said surfactant is present in an amount of about 50 to about 100 mg/l.

47. The aqueous solution as defined in claim 1 further containing sulfate ions in an amount up to about 15 g/l.

48. The aqueous solution as defined in claim 1 further containing sulfate ions in an amount of about 0.5 to about 5 g/l.

49. A process for treating a receptive metal substrate to impart a chromate passivate film thereon which comprises the steps of contacting the substrate with a solution at a temperature of about 40° to about 150° F. having a composition of claim 1 or 2 or 3 or 4 or 5 or 6 or 7 or 8 or 9 or 10 or 11 or 12 or 13 or 14 or 15 or 16 or 17 or 18 or 19 or 20 or 21 or 22 or 23 or 24 or 25 or 26 or 27 or 28 or 29 or 30 or 31 or 32 or 33 or 34 or 35 or 36 or 37 or 38 or 39 or 40 or 41 or 42 or 43 or 44 or 45 or 46 or 47 or 48 for a period of time sufficient to form a passivate film thereon.

50. A process for treating a receptive metal substrate to impart a chromate passivate film thereon which comprises the steps of contacting the substrate with a solution at a temperature of about 40° to about 150° F. having a composition of claim 1 or 2 or 3 or 4 or 5 or 6 or 7 or 8 or 9 or 10 or 11 or 12 or 13 or 14 or 15 or 16 or 17 or 18 or 19 or 20 or 21 or 22 or 23 or 24 or 25 or 26 or 27 or 28 or 29 or 30 or 31 or 32 or 33 or 34 or 35 or 36 or 37 or 38 or 39 or 40 or 41 or 42 or 43 or 44 or 45 or 46 or 47 or 48 for a period of time sufficient to form a passivate film thereon, contacting the passivated substrate with a dilute aqueous rinse solution for a period of at least about one second containing a bath soluble and compatible silicate compound present in an amount effective to impart improved corrosion resistance and hardness to the passivate film, and thereafter drying the passivated silicate rinsed substrate.

* * * * *